United States Patent [19]

Faulconer et al.

[11] Patent Number: 4,561,853

[45] Date of Patent: Dec. 31, 1985

[54] BUOYANCY COMPENSATOR, BLADDER, AND PROCESS OF MANUFACTURE

[75] Inventors: Mark Faulconer, Costa Mesa, Calif.; Allan R. Langton, Aukland, New Zealand

[73] Assignee: U.S.D. Corp, Santa Ana, Calif.

[21] Appl. No.: 485,735

[22] Filed: Apr. 18, 1983

[51] Int. Cl.[4] ..... B63C 9/16

[52] U.S. Cl. ..... 441/106; 405/186; 441/116

[58] Field of Search ..... 441/106, 108, 111, 112–119; 405/186; 156/292, 308.4, 324.4

[56] References Cited

U.S. PATENT DOCUMENTS

| | | | |
|---|---|---|---|
| 3,390,482 | 7/1968 | Holtvoigt | 156/292 X |
| 3,545,017 | 12/1970 | Cohn | 441/112 |
| 4,137,585 | 2/1979 | Wright, III | 441/116 X |
| 4,241,118 | 12/1980 | Skelton et al. | 156/324.4 X |
| 4,370,374 | 1/1983 | Raabe et al. | 156/324.4 X |

FOREIGN PATENT DOCUMENTS

| | | | |
|---|---|---|---|
| 1127740 | 4/1962 | Fed. Rep. of Germany | 441/118 |
| 679610 | 9/1952 | United Kingdom | 441/118 |

*Primary Examiner*—Sherman D. Basinger

*Attorney, Agent, or Firm*—George F. Bethel; Patience K. Bethel

[57] ABSTRACT

The following specification discloses a buoyancy compensator bladder and method of manufacture therefor. The bladder has a plurality of gussets implaced therein in order to rigidify and maintain a pre-established general configuration to the bladder. A plurality of insets or pleats are implaced around the shoulder area to provide for a generally arcuate curvilinear conformation therearound. A nylon plastic coated material is used for the gussets having one side that can be bonded to the inner side of the bladder, while the other side is formed from a nylon having a higher melting temperature. The gussets that are made from the nylon coated material are folded and implaced within the bladder or cavity formed from a plurality of sheets, the combination of which is brought together and heatset by means of an RF heater, or other suitable heater. The gusset material is formed from a nylon fabric having a polyurethane coating thereon formed from a liquidous first coating with two sheets adhered thereto to form a thickened polyurethane coating over one surface thereof without completely penetrating through the interstices to the other side to the extent where it would melt and bind during the forming operation.

6 Claims, 9 Drawing Figures

BUOYANCY COMPENSATOR, BLADDER, AND PROCESS OF MANUFACTURE

BACKGROUND OF THE INVENTION

The background of this invention lies within the buoyancy compensator art wherein a buoyancy compensator or inflatable vest means are utilized to provide buoyancy to a diver. More specifically, it resides within the aspects of forming a buoyancy compensator with a particular configuration having an air holding cavity or bladder interiorly thereof.

The particular configuration involves the utilization of a buoyancy compensator bladder or cavity that is formed with inherent characteristics that provide for a specific conformed configuration of the bladder. The process for forming the bladder utilizes a heat setting thermoplastic with gussets formed from a plastic coated fabric that provides the conformation without adhesions on the interior thereof.

THE PRIOR ART

The prior art with regard to buoyancy compensators and buoyancy compensator bladders generally revolves around the initial art for life vests. Initially, life vests were utilized for supporting people in the water in the form of kapok vests and inflation devices. The inflation devices during a period of development were those that were referred to as a Mae West during the second world war.

During the development of life preservers and flotation devices, it was common to adopt the general Mae West principles. This included the utilization of a horse collar type of arrangement that terminated in two flotation chambers over one's chest. The vest was held by straps and accordingly supported the user in the water. The support was generally in the frontal area of the chest and did not provide adequate positioning and displacement of the body with respect to the water.

Since the advent of sport and commercial diving certain people have advocated the utilization of a buoyancy compensator. The buoyancy compensator can provide for a certain amount of positive displacement with respect to the weights used by a diver. The compensation allows a diver to hopefully obtain a neutral buoyancy at certain levels, so that substantial effort will not have to be utilized in order to maintain a particular position at a particular depth. In other words, the principle being that buoyancy can be provided at certain depths that will allow the user to maintain those depths without struggling to either descend to maintain the depth, or ascend against the respective natural buoyancy of the diver at those particular depths.

To this end, a buoyancy compensator has been an accessory used by most divers to adjust their buoyancy. This has taken the form of the Mae West type of vest which can be inflated and deflated at certain levels, as well as other configurations that cross the chest in some cases or cross the back in conjunction with a backpack. Such buoyancy compensators oftentimes incorporate a bladder with an external cover portion. The bladder and external portion or cover are formed in a configuration utilized to provide a specific required buoyancy to a diver.

Certain buoyancy compensators utilize only an outer material without a bladder, while others utilize a bladder and outer cover. Regardless of the foregoing, it has been found that such bladders and buoyancy compensators expand outwardly in a cumbersome manner. This expansion causes a pillowing effect or a puffing outwardly, so that the diver is placed into an unwieldly and ungainly position in order to swim and appropriately maneuver with the buoyancy compensator. The puffed-out feeling extends through the diver's arms, across his chest and across his back. This, of course, eliminates the effectiveness of the buoyancy compensator by virtue of the fact that the diver must struggle within the buoyancy compensator to move, while at the same time recognizing the fact that the buoyancy compensator is supposed to help maintain equilibrium and not cause the diver to exert himself unduly.

In order to provide for a smooth-fitting, easily used buoyancy compensator, the Applicants, with respect to this invention, have developed a buoyancy compensator bladder and a unitary buoyancy compensator formed with unique gussets and pleats in order to prevent the puffing and pillowing attendant with the prior art. The bladder and the buoyancy compensator are specifically made in a process for conforming the bladder and buoyancy compensator to a prre-established configuration.

The pre-established configuration for the buoyancy compensator incorporates the utilization of a yoke arrangement depending into two frontal inflation areas and two rear inflation areas that are separated by a space into which a backpack is fitted.

The frontal yoke portion comprises two major pockets or channels that communicate with two major pockets or channels at the back. The yoke surrounds a user's neck and is configured to lie in a generally conformable relationship to a user's body between the neck, shoulder area, and frontal and back portions by virtue of certain unique gussets and pleats.

The gussets are formed from a plastic coated fabric, such as a polyurethane coated nylon wherein only one side is coated. The non-coated side can be brought together and formed in a heatsetting relationship with the coated side of the gussets adhering to the interior portions of the respective pockets or channels.

In particular, the gussets are made with a nylon woven fabric having one side that is coated with a polyurethane that can be heatset to the bladder interior. It generally comprises a thermoplastic that flows at a particular temperature and will bond to a second plastic material at the inside of the bladder. The second material in this particular instance is the interior portion of the pockets of the buoyancy compensator or bladder that can also be formed of a thermoplastic and heatset at the edges thereof. In this manner, a bond is established between the gussets and the interior of the bladder or buoyancy compensator without the need for exterior adhesives or other materials.

The gusset has a non-coated side so that when it is folded over to allow its plastic coated side to be attached to the interior of the pockets or channels, the interior of the gusset will not bond to itself. This is due to the fact that the gusset substrate is made from a material that will not melt at the temperature of the plastic urethane coating. The substrate can be a natural fiber or a synthetic fiber of a higher melting temperature than the thermoplastic of the polyurethane which is coated on the fabric substrate.

The foregoing allows for the manufacture and process to make a buoyancy compensator bladder and buoyancy compensators without multiple operations and without fillers to prevent adhesions. The elimination of adhesions and the overall conformation provided by this invention, provides a substantially superior buoyancy compensator over that of the prior art. This is due to the configuration and the overall ability to establish gussets within a buoyancy compensator or buoyancy compensator bladder without separate bonding, or adhesions that would create a problem in either manufacture or subsequent use. As a consequence, this invention is a substantial step as to its configuration and process over the prior art, as will be seen in the specification hereinafter.

SUMMARY OF THE INVENTION

In summation, this invention comprises a superior buoyancy compensator or buoyancy compensator bladder having unique internal gussets formed from a process that can be a unitary process without multiple adhesions, multiple bonding, or other steps.

More particularly, the invention comprises a buoyancy compensator or buoyancy compensator bladder formed from two major sheets of material. The major sheets of material are configured so that they provide for a yoke into which a user's neck can pass formed by two major frontal pockets or channels and two major back pockets or channels that can have a backpack placed between them.

The two major frontal and rear pockets or channels are both provided with elongated gussets. The elongated gussets are formed between the two major sheets of material by a single heatsetting operation.

The heatsetting operation is such that it provides a bond of the outer edge of the respective major front and rear sheets so as to provide for a complete peripheral bonding of the sheets so that a major pair of pockets in the front and back are formed thereby.

The gusset material is initially formed from a nylon substrate that has been coated on one side with a polyurethane coating. The polyurethane coating is a thermoplastic which will bond and melt at certain elevated temperatures which are below the temperature of the substrate or nylon material.

The gussets in the practice of the process are formed as elongated sheets that are folded over on themselves on the side that is not to be bonded. The side that is not to be bonded is the non-coated side. The coated side is then allowed at its exposed surface to be adhered to the interior of the two major sheets forming the buoyancy compensator pockets. This is by way of heatsetting the coated side of the gussets at the time of heatsetting the peripheral portions of the buoyancy compensator around the edge of the two major sheets.

The end product is a buoyancy compensator product which does not adhere internally and does not require any spacers or other material to prevent the improper adhesion or lack of conformation that is desired by this invention. As a consequence, the entire invention is a step over the art by virtue of its process of manufacture and the end result of the buoyancy compensator and/or its attendant bladder as is made through the process described hereinafter.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
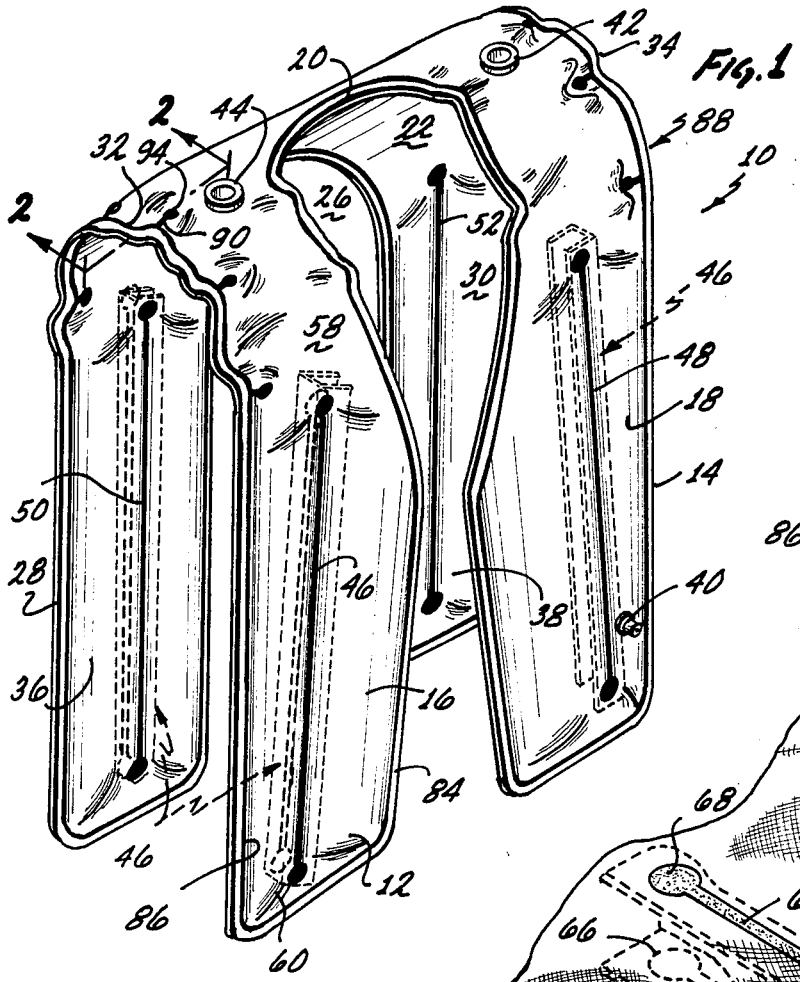
FIG. 1 shows a full perspective view of a buoyancy compensator bladder that can be made with the process of this invention.

Looking particularly at FIG. 1 and the figures taken therefrom, it can be seen that a buoyancy compensator bladder 10 has been shown. The buoyancy compensator bladder 10 can be substituted as a complete buoyancy compensator configuration. However, in this particular instance it is shown as a bladder that can be inserted into an outer covering that generally follows the same configuration.

The covering configuration is such that it is stitched around the edges of the buoyancy compensator bladder. It can be utilized in the same manner as the bladder and buoyancy compensator in a companion U.S. patent application entitled Buoyancy Compensator, Ser. No. 461,180, filed Jan. 26, 1983 now U.S. Pat. No. 4,523,914. In that application, it can be seen that the buoyancy compensator bladder 10 has been inserted into a covering generally conforming to the outside having straps for attachment to a user's body and an area for receipt of a backpack.

Looking more specifically at the buoyancy compensator bladder 10, that can also be the entire unit, it can be seen that two elongated frontal portions 12 and 14 have been shown. The elongated frontal portions 12 and 14 form extended chest cavities, pockets, or channels generally extending interiorly and along the length thereof. The cavities or channels 16 and 18 conform to the outer configuration and are free to communicate with each other, as to filling air and pressure.

The buoyancy compensator bladder has a yoke or collar area 20. The yoke or collar area 20 forms an opening 22 for receipt of a user's neck.

A second opening 26 in the back of the buoyancy compensator receives a backpack therein. The opening 26 is surrounded by two elongated portions 28 and 30. The elongated portions 28 and 30 are back portions that extend down a user's back and are held in situ on a user's back either by straps or other suitable means.

In the shoulder area it can be seen that two arcuate shoulder portions 32 and 34 are shown. The arcuate shoulder portions 32 and 34 reside in a configuration around a user's shoulder in order to conform thereto. The shoulder portions can be of any suitable configuration and can have inserts for being received under the arms of a user or can be formed in any other manner. Regardless of the foregoing, the thought is that the shoulder portion should conform to a user's body in the shoulder area in a suitable manner, so as to provide movement and comfort.

Each of the back portions 28 and 30 have a major channel 36 and 38 therein. The channels or pockets 36 and 38 are formed in a manner whereby they communicate with the shoulder area and the major frontal channels or pockets 16 and 18. The back channels or pockets are utilized for providing buoyancy to the back of a user, which is not generally the case in the prior art.

In order to fill the interior of the buoyancy compensator bladder 10, a valve member can be utilized through a valve fitting, such as valve fitting 40 or valve fittings 42 or 44. These valve fittings can provide rapid inflation such as through valve fitting 40; power inflation such as through valve fitting 42; or dumping or filling of gas as through valve fitting 44. Also, exhalation and inhalation of gas into and from within the buoyancy compensator can be accommodated through valve 42. Many valving configurations are known in the prior art for dumping the gas within the buoyancy compensator, as well as providing other functions for filling the buoyancy compensator in various modes.

Each of the major channels 16 and 18 and the back channels or back pockets 36 and 38 have at least one gusset such as gussets 46 and 48, and the back gussets 50 and 52. The front gussets 46 and 48 or ribs or expansion struts or members are similar in great measure to the back gussets 50 and 52 and are conformed in the same manner as will be described hereinafter.

Figure 3:
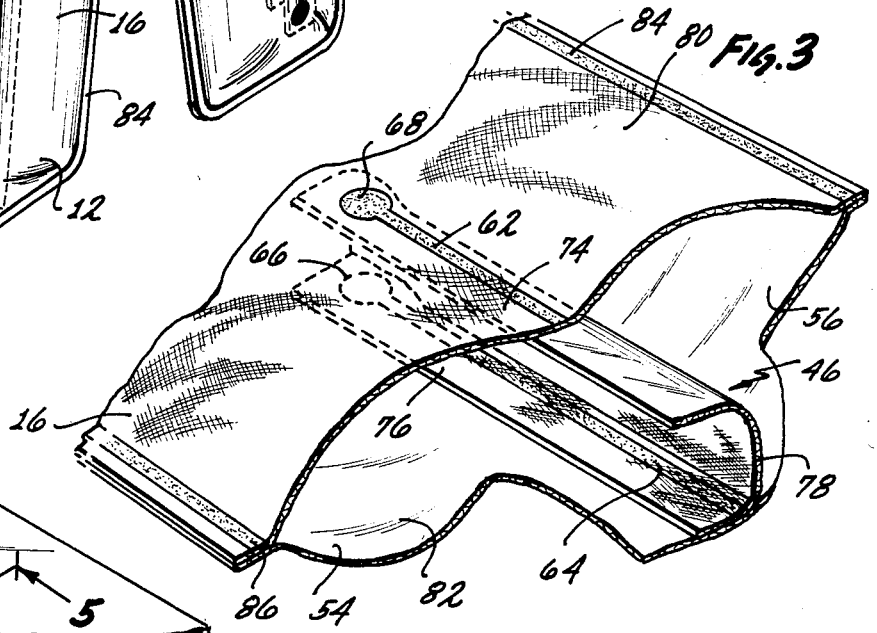
FIG. 3 shows a sectional perspective view looking through one of the major pockets of the front or the rear of the buoyancy compensator of this invention.

The ribs or gussets 46 and 48 are shown in greater detail in the sectional view of FIG. 3.

The sectional view of FIG. 3 shows an exemplary area, such as the major channel or pocket 16 which in sectional view is similar to major channels or pockets 18, 36 and 38. Each channel or pocket, such as channel or pocket 16 comprises at least one gusset or rib, such as rib 46 forming a pair of elongated divided channels 54 and 56. The divided channels 54 and 56 communicate with each other, such as at the top of the channel 58 and bottom of the channel 60 of the major channel or pocket 16. These channels 54 and 56 can be further divided by other ribs 46 which have not been shown so as to provide for stiffer ribbing and gusseting of the entire bladder or buoyancy compensator.

The rib or gusset 46 is heatset by means of flowing, melting, or softening a portion of the rib 46 along a heat seal line 62 that forms an elongated heatset. This elongated heatset on one side is matched by a second elongated heatset 64 on the other side. The second elongated heatset 64 with the first elongated heatset 62 can be made in a simultaneous manner with the method and apparatus to be described hereinafter.

Both of the elongated heatset portions of the rib 46 terminate in expanded or bulbous portions 66 and 68. The expanded portions 66 and 68 serve to reinforce the ends of the elongated heatset portions 62 and 64. This aids in preventing tearing or delamination of the heatset portions 62 and 64 by spreading the load and strengthening the terminal portions thereof. These elongated heatset portions 62 and 64 can be formed by way of any suitable tacking or heatsetting to the inner portion of the buoyancy compensator bladder as will be described hereinafter.

Heatsetting of the elongated portion 62 and 64 provides an adhered lateral portion 74 along one surface and a second adhered lateral portion 76 along another portion. The adhered lateral portions 74 and 76 are formed as interfacing portions and terminate in an upright portion 78. The upright portion of the rib 78 provides for the controlled outward expansion of the buoyancy compensator to be described hereinafter.

The buoyancy compensator bladder or buoyancy compensator can comprise two major sheets, such as a major frontal sheet 80 and a rear sheet 82. The major frontal sheet 80 and rear sheet 82 are bonded and heatset along a peripheral portion by flowing or elevating the temperature so as to cause a melt of the material into each other from the frontal portion 80 to the back portion 82 or vice versa along a heatset seal 84 on one side and a heatset portion 86 along another.

The heatset seals 84 and 86 seal the two major sheets 80 and 82 together. The major sheets 80 and 82 are formed from any kind of plastic material or coated material that will accept the adhesion of the coating material of the ribs 46. For example, the bladder or buoyancy compensator can be made of a urethane plastic, a vinyl, a coated natural textile material, a rubberized material, a plastic elastomer, a thermo elastic plastic, or any other suitable material for forming the bladder or the buoyancy compensator. The thought being that the sheets 80 and 82 must be capable of receiving the coating to be described hereinafter on the rib by adhering it thereto through heat setting.

As an aside, a feature of this invention resides within the shoulder portions 32 and 34 which have been provided with pleats 88 around the outer portions thereof. The pleats 88 are such that they are formed by crimping a longitudinal pleat portion 90 which terminates in a bulbous portion 94. The longitudinal and bulbous portions 90 and 94 pleat the outer shoulder portion such that the shoulder area is provided with a pleated rounded configuration.

Figure 2:
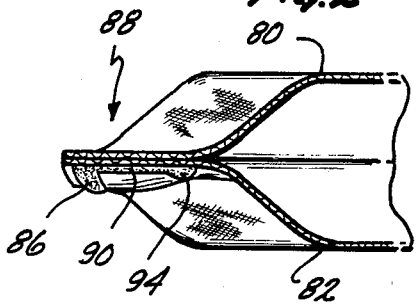
FIG. 2 shows a sectional view of the edge portion at the shoulder of the buoyancy compensator in the direction of lines 2—2 of FIG. 1.

The respective longitudinal pleat and bulbous portions 90 and 94 are formed by heatsetting the front sheet 80 and back sheet 82 as can be seen in FIG. 2. This is shown in greater detail in FIG. 2 whereby it can actually be seen that a flow of material has taken place between the front sheet 80 and the rear sheet 82 interiorly of the heatset portion 86. Here again, the reason for the bulbous or expanded portion 94 is similar to expanded portions 66 and 68 to provide for tear resistance. If the sheets 80 and 82 begin to spread apart with substantial tension they will have more surface area bonded to each other than the mere longitudinal portion of the pleat 90.

Figure 4:
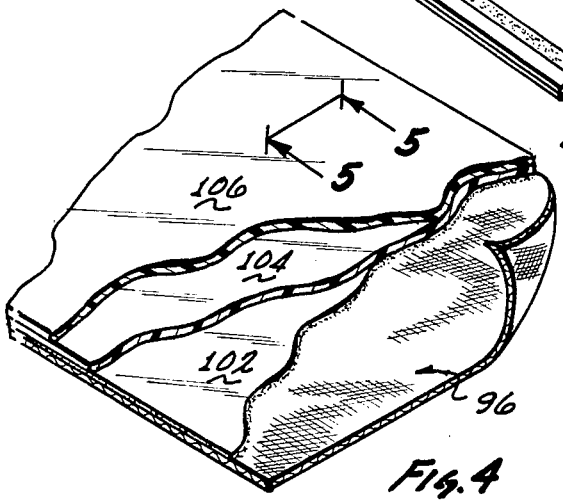
FIG. 4 shows a view of the fabric used within the gussets for practicing the process of this invention.
Figure 5:
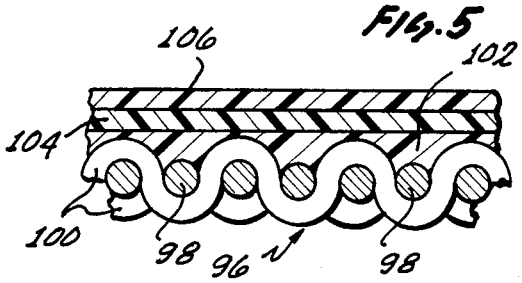
FIG. 5 shows a sectional view of the fabric as sectioned in the direction of lines 5—5 of FIG. 4.
Figure 6:
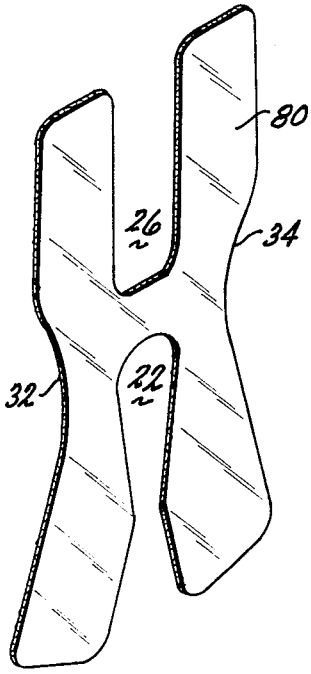
FIG. 6 shows one of the major sheets utilized in this invention for forming the buoyancy compensator.

Looking more particularly at the gusset material in FIGS. 4 and 5, it can be seen that a substrate of woven textile material 96 has been shown. The woven material 96 can be formed from nylon, a coated plastic, a natural fabric, or any other suitable material for purposes of providing the effect as hereinafter described. Also, any non-woven or sheet material can be utilized, so long as it has a higher melting temperature than the plastic coating described hereinafter. The woven material has been shown in FIG. 5 having warp threads 98 and fill threads 100. These two respective warp and fill threads 98 and 100 have been woven into a tightly woven nylon material having the capability of maintaining very tight interstices between the warp and the fill. The base material 96 formed of the warp and fill threads that can be, as previously stated, made of nylon, other synthetic analogous materials, or a natural fabric, as well as formed of a higher melting temperature sheet, is then coated on one side with a plastic coating 102, such as a polyurethane. The polyurethane coating 102 fills the interstices sufficiently so that small air passages will not occur through the fabric 96.

After the foregoing coating 102 has been applied, a pair of thin film sheets 104 and 106 are utilized. These thin film sheets are placed in tandem over the coating 102 and heatset thereto. In this manner, a completely uniform material is flowed between thin film sheets 104 and 106 and the coating 102. This forms a unified meltable polyurethane material adhered to the fabric 96 that can then be melted or elevated in temperature to provide flow in order to create a bonding as will be described hereinafter. However, any substrate having a higher melting temperature than the thermoplastic coating can be utilized.

Figure 9:
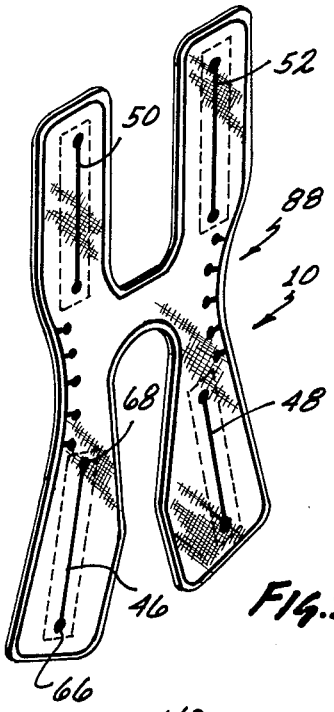
Figure 7:
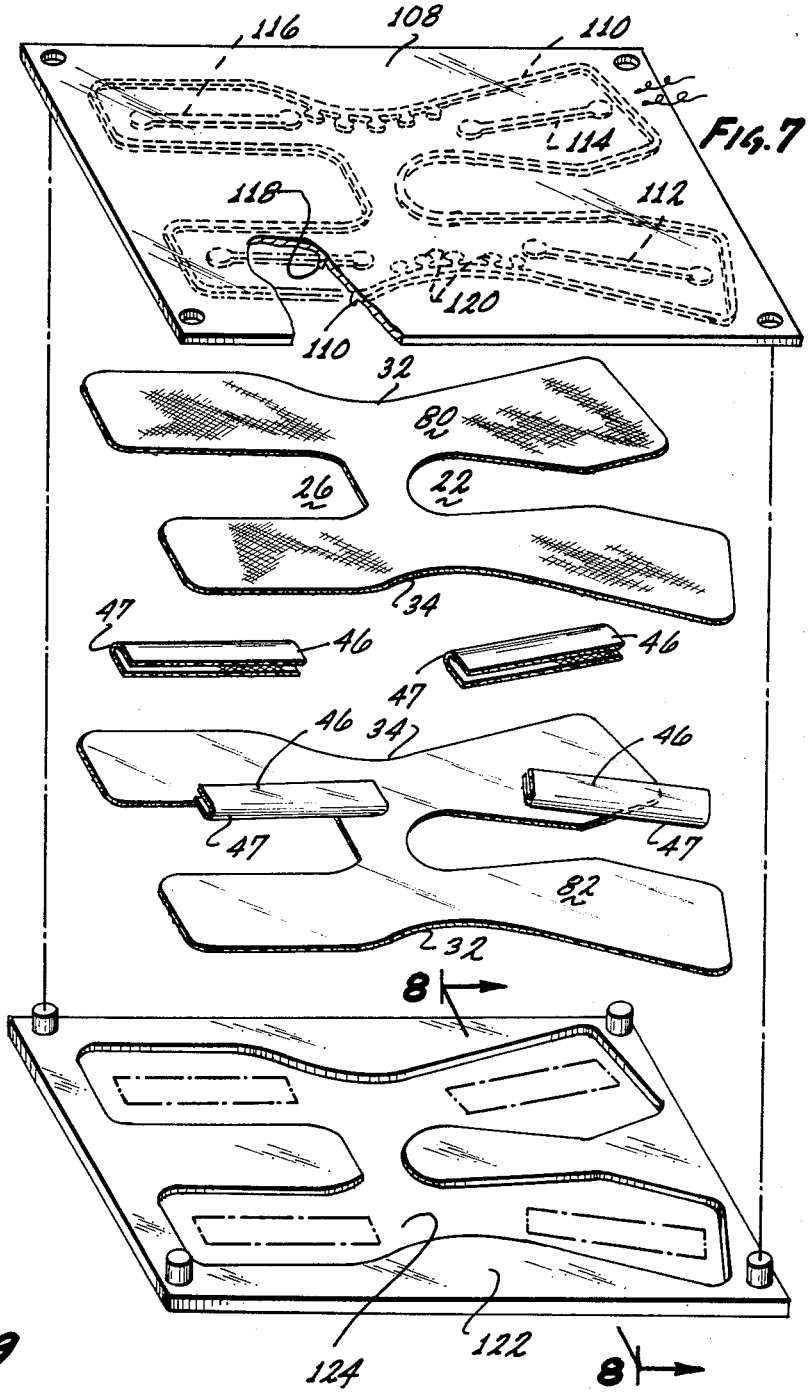
FIG. 7 shows an exploded view of the mold surfaces and materials that are used to form this invention.
Figure 8:
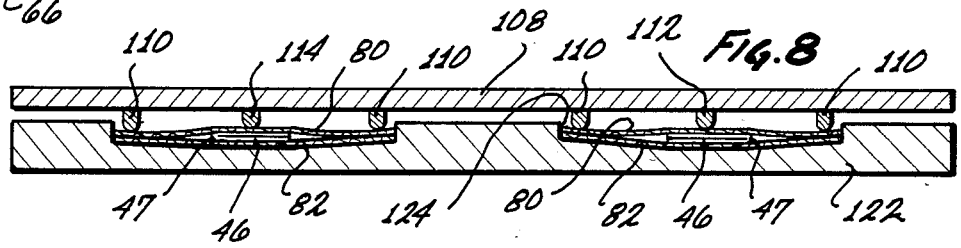
FIG. 8 shows a sectional view of the molds of FIG. 7 in place during the forming operation and the cavities therein in the direction of lines 8—8 of FIG. 7; and, FIG. 9 shows a product which has been formed from the molding operation of this invention.

Looking more particularly at the apparatus and process in the exploded view of FIG. 7 and the views of FIGS. 8 and 9, it can be seen that an upper sheet 80 and lower sheet 82 are to be placed in a mold. An upper platen 108 is shown with a heating element 110. The heating element 110 generally conforms to the heatset periphery 84 and 86 of the finished buoyancy compensator or bladder.

The platen 108 also incorporates heating elements 112, 114 and 116 and 118 that generally conform to the ribs or gussets 46, 48, and the back gussets 50 and 52. The foregoing platen 108 also has heating elements 120 that are formed as pleat heating elements to form the pleats 88 around the periphery of the shoulder region.

The platen 108 with the heating elements thereunder can be configured in any suitable manner in order to provide the heat for heatsetting. However, in this case, the heating elements are provided with RF heating between the upper platen 108 and a lower platen 122. The lower platen 122 serves along with the other platen 108 to perform the function of an RF network and is included in the coupled RF circuit thereof. When electronically driven, the RF energy is sufficient to heat the heating elements 110, 112, 114, 116, 118 and 120. The heating elements can be in the form of a brass bead or wall circumscribing the area to be heatset in the manner as shown.

The RF heating can also be substituted by convection, contact heating, or radiation utilized for the heating and sealing on the periphery 84 and 86 to form the beads 62 and 64, as well as the enlarged portions 65 and 66 and pleats 88. It has been found with the materials being used that the foregoing RF heating is quite acceptable.

The upper sheet 80 and the lower sheet 82 are brought together with four strips of rib or gusset material to form ribs or gussets 46. The ribs or gussets 46 are fundamentally folded over portions of elongated material, such as that shown in FIGS. 4 and 5. In order to have the elongated portions of the ribs 46 retain their folded condition during processing, a temporary adhesive can be implaced in the V edge, or folded portion 47 of the rib 46. The folded edge 47 can be held together by an adhesive or in any other manner, so that the folded ribs or the stock forming the ribs is laid down and maintained in a folded condition between the upper sheet 80 ahnd the lower sheet 82.

After the two respective upper and lower sheets 80 and 82 are placed in overlying relationship with the ribs 46 between them in the folded relationship as shown, the upper platen 108 and lower platen 122 come together to press the upper sheet 80 and lower sheet 82 together with the rib or gusset material 46 therebetween having the adhesive in the folded V or edge portion 47 therebetween. RF energy is thereafter applied to the RF conductors or heating elements 110, 112, 114, 116 and 118, as well as the pleat conductors 120 in order to heat seal the materials together. The foregoing, of course, can be done by means of radiation, convection contact, or other heating other than RF, in order to cause the flow of the thermoplastic material 104 and 106 into the bladder material along heatset lines 62 and 64, as well as along the periphery at the headset portions 84 and 86 around the edge thereof.

The ribs 46 can be formed of any inner substrate substituted for the nylon fabric 96, so long as it has a higher melting temperature than the thermoplastic coating. The thought being, to maintain the inner portions of the ribs 46 without adhesion to each other, while heatsetting the polyurethane or thermoplastic coating to the inner walls of the bladder sheets 80 and 82.

The foregoing generally constitutes a basis wherein the buoyancy compensator bladder is left in a cavity 124 of the lower platen 122 and then can be removed as an integral part providing the finished product in its flattened condition shown in FIG. 9. The buoyancy compensator bladder 10 in its flattened condition can then be expanded by blowing up the buoyancy compensator and allowing the channels 54 and 56 to expand outwardly until the rib wall or upright portion 78 of the gusset or rib has expanded to its fullest degree. In this particular condition, the gusset or rib wall 78 serves to extend in tension and provide for uniform expansion.

Uniformity can also be greatly enhanced by having a plurality of ribs 46 within the major channels or pockets 12, 14, 36 and 38, thereby creating a plurality of channels 54 and 56 within the pockets or main channels. Thus, any number of channels 54 and 56 can be utilized with the ribs 46 to accommodate various configurations of the buoyancy compensator or any other underwater support device which requires limited expansion in a specific configuration.

In light of the foregoing, it can be seen that this invention is a broad process and broad apparatus with regard to a buoyancy compensator, or bladder, over that of the prior art and should be given great scope with regard to any limitations placed upon the following claims.

We claim:

1. A diver's buoyancy compensator having an inflatable cavity formed from major sheets defining at least a portion of the cavity wherein the improvement comprises:

said major sheets on the interior side thereof being bonded within the cavity along an elongated portion thereof by heatsetting a heatsettable material on the interior of one major sheet to the interior of the other major sheet;

said elongated heat-set portions being terminated in an expanded heat-set area to reinforce the ends of the heat-set elongated portions, thereby bonding the interior portions of each sheet to each other within the cavity and forming a bladder internally of the buoyancy compensator;

at least two frontal major channels in the front portion thereof that are each divided by at least one gusset that is heatset to the interior portion of the major sheets which are conformed to provide a yoke therearound;

at least two major channels at the rear thereof divided by a space adapted to receive a backpack; and further comprising, at least one gusset between the interior surfaces of the major sheets of each major rear channel; and, an arcuate shoulder portion having pleats therein that are heatset around the periphery thereof.

2. The process for making a buoyancy compensator bladder adapted for placement in an outer covering material comprising:

providing a first and second platen having heating means thereon which can heat the outer periphery of a conformation of a buoyancy compensator and interior portions thereof;

providing a first major sheet of heatsettable plastic material;

providing a second sheet of heatsettable plastic material, both of said first and second sheets conforming to the outline of a buoyancy compensator bladder;

providing a thermoplastic material on a substrate wherein said substrate has a higher melting temperature than said thermoplastic material;

folding said thermoplastic material so that the thermoplastic material of a lesser melting temperature is exposed on either side and overlays the interior substrate of higher melting temperature;

placing said thermoplastic material between said first and second sheets within the area of said interior heating means of said platen; and, heatsetting said thermoplastic sheets to the major sheets to form a span interiorly therebetween and terminating said heatset thermoplastic sheets in expanded portions for reinforcement thereof.

3. The process as claimed in claim 2 further comprising:

heatsetting the portions around the periphery of said major sheets so as to form a bond between the edges of said major sheets.

4. The process as claimed in claim 3 wherein:

said major sheets are formed from a thermoplastic material.

5. The process as claimed in claim 4 wherein:

said thermoplastic material of lower melting temperature has been at least partially coated on said substrate of higher melting temperature that is in the form of a textile material; and wherein, said thermoplastic material when folded over on itself is provided with an adhesive to retain the folded edge along said thermoplastic material with said substrate therebetween.

6. The process as claimed in claim 4 wherein:

said thermoplastic material of lesser melting temperature is formed from a polyurethane coating and at least one sheet that has been adhered onto a nylon textile material of a higher melting temperature than said polyurethane.

* * * * *